US007343132B2

(12) United States Patent
Kimura et al.

(10) Patent No.: US 7,343,132 B2
(45) Date of Patent: Mar. 11, 2008

(54) IMAGE FORMING APPARATUS AND PROCESS CARTRIDGE INCLUDING SEALABLE LUBRICATING DEVICE

(75) Inventors: Yoshiyuki Kimura, Meguro-ku (JP); Atsushi Sampe, Yokohama (JP); Hiroyuki Nagashima, Yokohama (JP); Nobuo Kuwabara, Yokohama (JP); Hiroshi Hosokawa, Yokohama (JP); Wakako Murakami, Suginami-ku (JP)

(73) Assignee: Ricoh Company, Ltd., Tokyo (JP)

( * ) Notice: Subject to any disclaimer, the term of this patent is extended or adjusted under 35 U.S.C. 154(b) by 201 days.

(21) Appl. No.: 11/226,197

(22) Filed: Sep. 15, 2005

(65) Prior Publication Data

US 2006/0062612 A1 Mar. 23, 2006

(30) Foreign Application Priority Data

Sep. 17, 2004 (JP) ..... 2004-271386

(51) Int. Cl.
*G03G 21/00* (2006.01)

(52) U.S. Cl. ..... 399/346

(58) Field of Classification Search ..... 399/343, 399/345, 346

See application file for complete search history.

(56) References Cited

U.S. PATENT DOCUMENTS 7,035,582 B2 * 4/2006 Suda et al. ..... 399/346
2004/0101328 A1 5/2004 Kimura et al.
2004/0131381 A1 7/2004 Kawasumi et al.
2004/0136763 A1 7/2004 Murakami et al.
2004/0141779 A1 7/2004 Yanagida et al.
2004/0170446 A1 9/2004 Nagashima et al.
2004/0170447 A1 9/2004 Arai et al.
2004/0170455 A1 9/2004 Shintani et al.
2004/0184841 A1 9/2004 Tsuda et al.
2004/0202495 A1 10/2004 Koike et al.
2004/0213597 A1 10/2004 Yanagida et al.
2004/0223782 A1 11/2004 Hosokawa et al.
2004/0265011 A1 12/2004 Tsuda et al.
2005/0002705 A1 1/2005 Shintani et al.
2005/0025520 A1 2/2005 Murakami et al.
2005/0036805 A1 2/2005 Murakami et al.
2006/0062612 A1 3/2006 Kimura et al.

FOREIGN PATENT DOCUMENTS

JP 09-090839 4/1997
JP 2000-231298 8/2000

OTHER PUBLICATIONS

U.S. Appl. No. 11/565,404, filed Nov. 30, 2006, Nagashima et al.
U.S. Appl. No. 11/736,881, filed Apr. 18, 2007, Hosokawa et al.

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus including an image support body; and a lubricant applying part configured to apply lubricant to a surface of the image support body, and including a lubricant containing member configured to seal the lubricant in the lubricant applying part.

20 Claims, 5 Drawing Sheets

IMAGE FORMING APPARATUS AND PROCESS CARTRIDGE INCLUDING SEALABLE LUBRICATING DEVICE

CROSS-REFERENCE TO RELATED APPLICATIONS

This application claims priority to Japanese Patent Application No. 2004-271386, filed on Sep. 17, 2004, the entire contents of which are incorporated herein by reference.

BACKGROUND OF THE INVENTION

1. Field of the Invention

The present invention relates to an electrophotographic image forming apparatus such as a copier, a printer, and a facsimile. More particularly, the present invention relates to a process cartridge including a lubricant applying part and a toner used in the image forming apparatus and the process cartridge.

2. Discussion of the Related Art

In a related art, a lubricant (generally, stearic acid zinc) is applied to a photoconductor and intermediary transfer belt using an application roller such as a brush roller or a sponge roller to improve the life of the belt, to prevent a worm-eaten like defect on the image at the time of transcription, and to improve transcription characteristics.

However, because the lubricant is pressed against the lubricant application roller with a weight or a spring, fibers of the brush roller fall down or deformation of the application roller occurs over time. In particular, when an image forming apparatus is assembled in a factory, the above-mentioned malfunction conspicuously occurs due to the amount of lubricant and the high level of spring pressure. In addition, when the lubricant is installed in the apparatus (e.g., at factory assembling time or service exchange time), it is difficult to set the lubricant with pressure against the application roller.

SUMMARY OF THE INVENTION

To resolve this problem and other discovered problems described in the Detailed Description of the Preferred Environments, in the present invention, a lubricant is sealed at a time of shipment of a PCU or an image forming apparatus to prevent the release of fibers of a brush roller or to prevent deformation of a sponge roller by preventing the lubricant from contacting the brush roller or the sponge roller. In addition, in a high temperature high humidity environmental condition, the present invention prevents the lubricant from changing to include excess water such that the lubricant adheres to the application roller. As a result, an inexpensive and high quality image forming apparatus is provided. In addition, when a lubricant is supplied as an exchange part, the handling of the lubricant is easy as it is sealed by a case. Moreover, when the lubricant is applied to the image forming apparatus as an exchange part, the setting performance for a service person is high because he is not required to touch the lubricant and can readily set the lubricant without pressure cancellation. Even more particularly, according to this invention, high-resolution pictures and an improvement of cleaning characteristics is achieved.

It is a general object of the present invention to provide a novel image forming apparatus that includes a lubricant applying device in which one or more of the above-described problems are eliminated.

More particularly, it is an object of the present invention to provide a novel and improved image forming apparatus that can maintain good performance in applying the lubricant.

Additionally, it is an object of the present invention to provide a novel process cartridge that includes the lubricant applying device.

Additionally, it is an object of the present invention to provide a novel toner preferably used in the process cartridge and the image forming apparatus.

To achieve the above-mentioned and other objects, there is provided according to one non-limiting embodiment of the present invention an image forming apparatus including: an image support body; and a lubricant applying device configured to apply a lubricant to the surface of the image support body, and including a lubricant containing member configured to seal the lubricant in the lubricant applying part.

Additionally, there is provided according to another non-limiting embodiment of the present invention a process cartridge for an image forming apparatus configured to be detachably mounted in the image forming apparatus. The process cartridge includes the image support body and the lubricant applying part.

Additionally, there is provided, according to another non-limiting embodiment of the present invention, toner for a development of an electrophotography process of an image forming apparatus, wherein each particle of the toner has an average roundness greater than or equal to 0.93 and smaller than or equal to 1.0.

According to benefits realized by the present invention, it is possible to provide an image forming apparatus that can have and maintain improved lubricant applying performance even if a polymerization toner is used.

Moreover, it is possible in view of the present invention to provide a process cartridge configured to use the lubricant applying device therein to prevent a lubricant applying malfunction of an image support body and to thereby form high-quality images.

Other objects, features, and advantages of the present invention will become more apparent from the following detailed description when read in conjunction with the accompanying drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
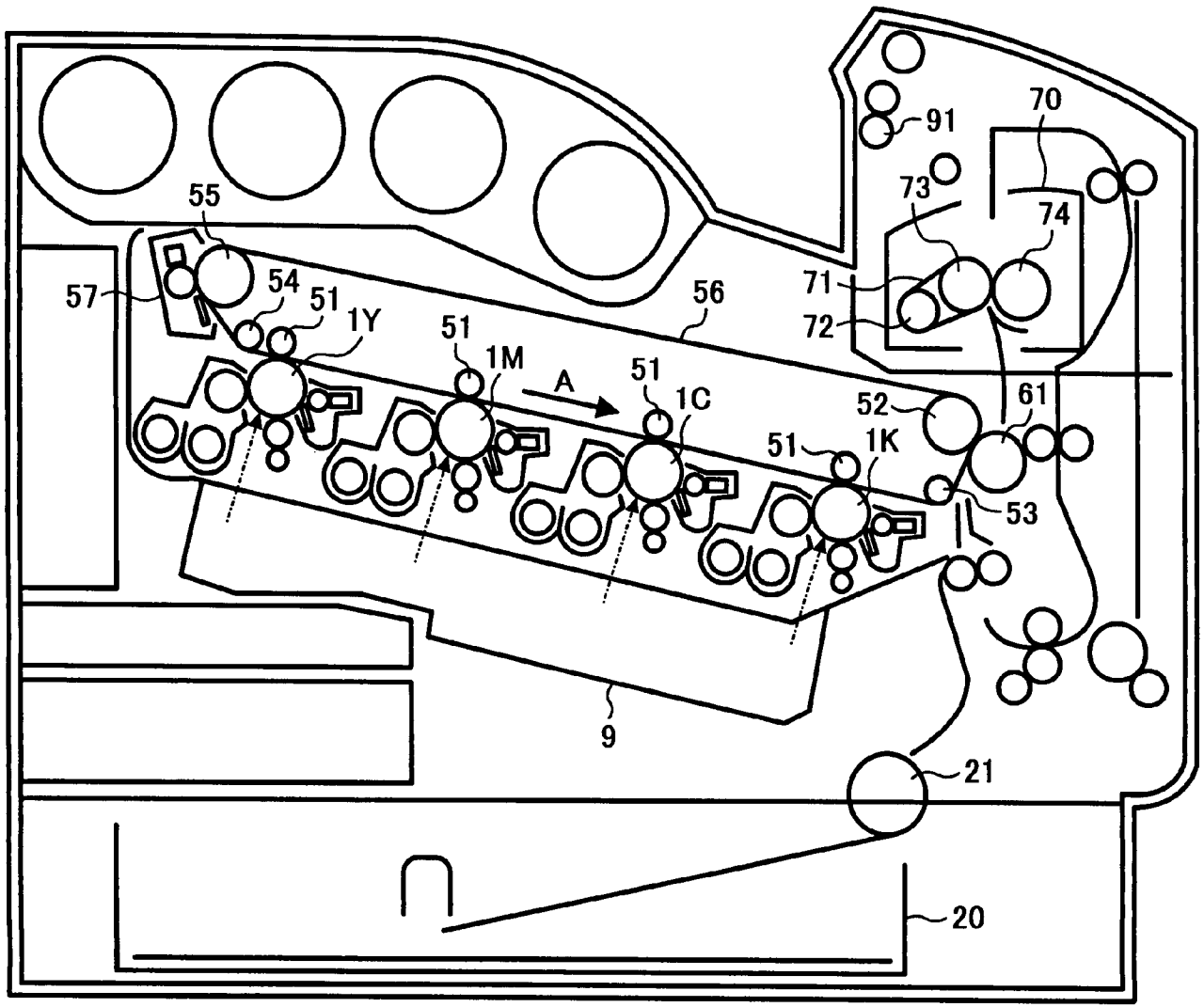
FIG. 1 shows an exemplary structure of an image forming apparatus according to an embodiment of the present invention.

Japanese Patent Laid-Open No. 2000-231298 and No. 09-090839 disclose an image forming apparatus which can prevent application unevenness, due to fallen fibers of the application roller, by adjusting the pressure applied to the application roller.

However, a lubricant application device with a pressure cancellation mechanism is complicated and expensive. In particular, in the case of a process cartridge (PCU) of a full color image forming apparatus, because each process cartridge requires the pressure cancellation mechanism, the required structure around the photoconductor becomes complicated and the image forming apparatus becomes expensive.

Even more particularly, when a product (image forming apparatus or PCU) is kept in a high temperature and high humidity environment such as a warehouse or a cargo area, a conventional lubricant changes to include much water. Consequently, the lubricant heavily adheres to an application roller, the saturation point of electrical potential of a photoconductor surface becomes low, the electrical potential decreases quickly, pollution of the sheet ground occurs (i.e., extraneous dots or lines form on the sheet), and blurring of a picture occurs.

Even more particularly, release of the fibers of the brush roller or deformation of the sponge roller results in an uneven application of lubricant, a worm-eaten like defect and a cleaning defect due to a lack of application of lubricant, and banding due to a torque change of the application roller.

A plurality of modes for carrying out the invention to address these problems are explained below using the figures. In addition, the following disclosure is directed to a best mode of the invention. However, the present invention is not limited to the specifically disclosed embodiments, and variations and modifications may be made without departing from the scope of the present invention.

Reference will now be made in detail to the various embodiments of the invention, examples of which are illustrated in the accompanying drawings. Wherever possible, the same reference numbers are used in the drawings and the description refers to the same or like parts.

The present invention is now described below in detail with reference to several embodiments and accompanying drawings.

FIG. 1 is an elevation view showing an image forming apparatus according to an embodiment of the present invention. The image forming apparatus has an intermediate transfer belt 56 provide in the center of the inside of the apparatus. The intermediate transfer belt 56 is an endless belt including substratums adjusted to a mid-level resistance by heat-resistant materials such as polyimide or polyamide. The belt 56 is hung on and supported by four rollers 52, 53, 54, 55, and rotates in the direction indicated by the arrow (A) illustrated in FIG. 1. Four image forming units corresponding to each color toner of yellow (Y), magenta (M), cyan (C), and black (K) are disposed under the intermediate transfer belt 56 along a belt surface of the intermediate transfer belt 56.

Figure 2:
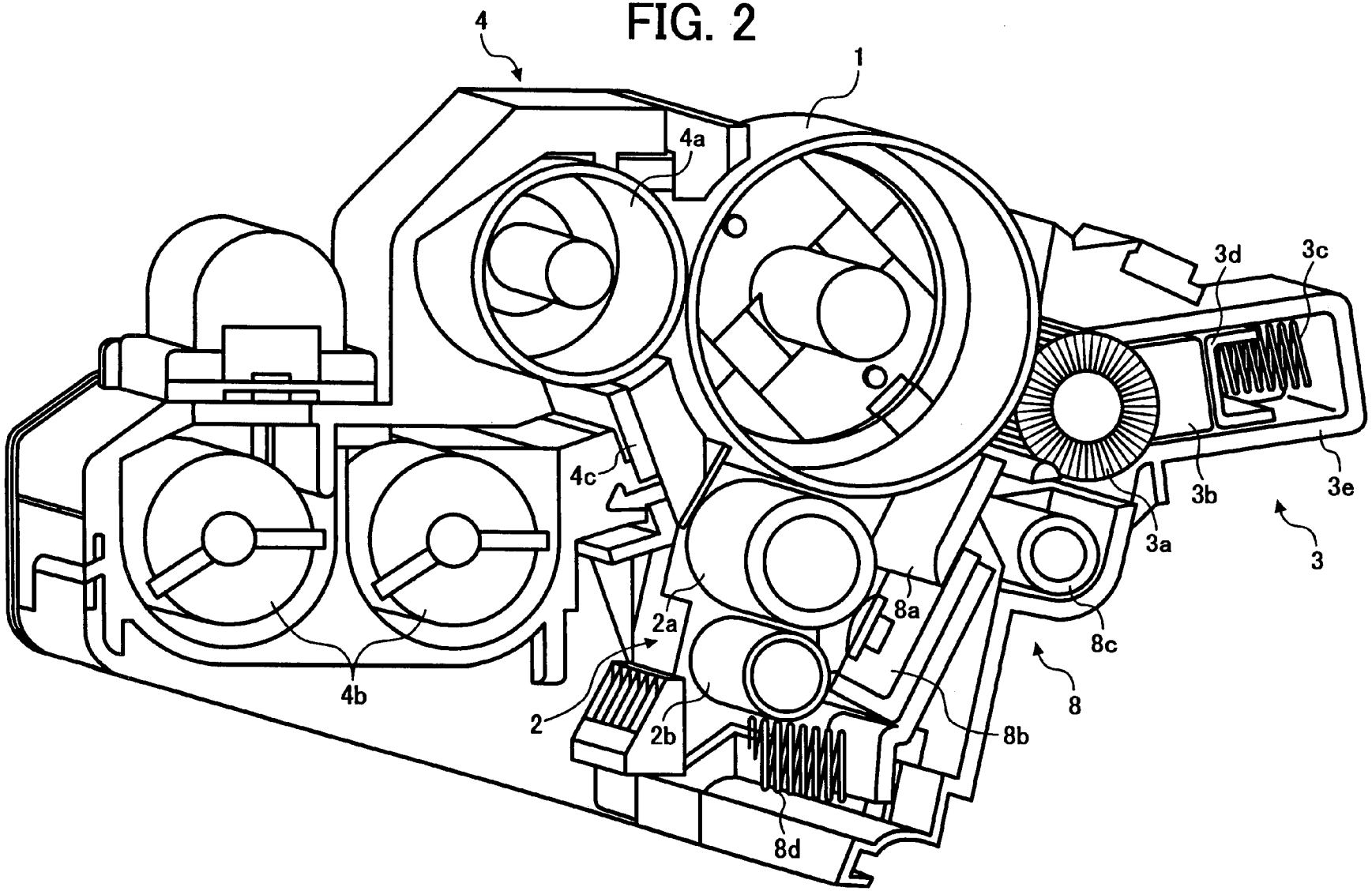
FIG. 2 is an enlarged view showing an image forming unit of the image forming apparatus shown in FIG. 1.

FIG. 2 is an enlarged view of one of the four image forming units. The reference characters indicating color (Y, C, M and K) are omitted because the arrangement of components around the photoconductors contained in each image forming unit is similar. That is, each image forming unit includes the photoconductors 1Y, 1C, 1M and 1K. Moreover, charging device 2 configured to charge the photoconductor 1, a developing device 4 configured to develop a latent image on the photoconductor 1 into a toner image, a lubricant applying device 3 configured to apply a lubricant to the photoconductor 1, and a cleaning device 8 configured to remove toner particles remaining on the photoconductor 1 are placed around the photoconductor 1, respectively. As constituted, the image forming unit 2 preferably can serve as a process cartridge. In addition, as shown in FIG. 1, an exposing device 9 configured to form a latent image on the surface of each photoconductor charged with electricity based on image data is disposed under the four image units 1Y, 1C, 1M, and 1K.

A first transfer roller 51 configured to transfer the toner image on the surface of the photoconductor 1 to an intermediate transfer belt 56 is placed at a position opposed to each respective photoconductor 1 across the intermediate transfer belt 56. The first transfer roller 51 is connected to a power supply (not shown) whereby a predetermined voltage is applied.

In addition, a second transfer roller 61 is provided so as to be brought into contact with the outside portion of the intermediary transfer belt 56 which is stretched on the supporting roller 52. The second transfer roller 61 is connected to the power supply (not shown) whereby a predetermined voltage is applied. A second transfer portion configured to transfer the toner image from the intermediate transfer belt 56 to a transfer material is formed between the intermediary belt 56 and the second transfer roller 61.

An intermediate transfer belt cleaning device 57 configured to clean the surface of the intermediate transfer belt 56 after a secondary transfer is provided so as to be brought into contact with the outside portion of the intermediary transfer belt 56 which is stretched on the supporting roller 55. A fixing device configured to semi-permanently fix the toner image on the transfer material is disposed above the second transfer portion. The fixing device includes an endless fixation belt 71 supported by a heat roller 72 having a Halogen heater inside and a fuser roller 73, and a pressure roller 74 disposed opposite to the fuser roller 73 with pressure across the fixation belt 71. A transfer material feeding device 20 configured to hold the transfer material and feed the transfer material to second transfer portion is also provided.

The characteristics of this image forming apparatus are explained below in detail. The photoconductor 1 is an organic photoconductor, and a surface protective layer is made from resin of polycarbonate.

With reference to FIG. 2, the charging device 2 includes a charging roller 2*a* that is made of a resilient layer of mid-level electrically resistant material covering the outside of electroconductivity metal core as an electricity charging member. The charging roller 2*a* is connected to the power supply (not shown) whereby a predetermined voltage is applied. The charging roller 2*a* is disposed having a minute gap relative to the photoconductor 1. The gap can be realized, for example, by contacting constant thickness spacers that are wound around a non-imaging area of ends of the charging roller 2*a* to the surface of the photoconductor 1. In addition, an electricity charging roller cleaning member 2*b* configured to contact with and clean the surface of the charging roller 2*a* is disposed adjacent to the charging roller 2*a*.

A developing device 4 including a developing sleeve 4*a* having a magnetic field forming member inside thereto is disposed at a position opposed to the photoconductor 1.

Two screw members 4*b* configured to mix the toner spent by a toner bottle (not shown) with developer, and draw the developer to the developing sleeve 4*a* by agitating the toner are disposed at the lower part from developing sleeve 4*a*. The thickness of the developer, including the toner and the magnetic carrier drawn by the developing sleeve 4*a*, is regulated by the doctor blade 4*c* and is carried by the developing sleeve 4*a*. The developing sleeve 4*a* and the surface of the photoconductor 1 move in the same direction in the developing area while the developing sleeve 4*a* carries the developer for the latent image on the photoconductor 1. In addition, FIG. 1 shows a constitution of the developing device 4 for a double component developer having a toner and a carrier. However, a single component developer including no carrier can be also used.

The lubricant applying device 3 includes a solid lubricant 3*b* set in a detachable fixed case and a brush roller 3*a* located so as to contact the solid lubricant 3*b* for scraping and applying the lubricant to the photoconductor 1. The solid lubricant 3*b* preferably has a rectangular solid form, and is pressed by a pressure spring 3*c* against the brush roller 3*a*. A spring such as a leaf spring or a compression spring can be used as a pressure application member 3*c*, and it is preferable to use the compression spring as shown in FIG. 2 in particular. Although the thickness of the solid lubricant 3*b* decreases with time, the pressure spring 3*c* applies a force to the solid lubricant 3*b* against the brush roller 3*a* and therefore the solid lubricant 3*b* is constantly pressed to contact the brush roller 3*a*. The brush roller 3*a* applies the lubricant that is scraped by rotation of the brush roller 3*a* to the surface of the photoconductor 1.

The lubricant applying device 3 is preferably provided next to the cleaning device 8. Consequently, toners remaining on the photoconductor 1 attach to the brush when the brush abrades the photoconductor 1. Then, the toners attached to the brush are removed by a flicker (not shown) and transferred to a collection and transfer means (not shown) or are collected when the toners attached to the brush contact the solid lubricant 3*b*.

The cleaning device 8 includes the cleaning blade 8*a*, a supporting member 8*b*, a toner collecting coil 8*c*, and a blade pressure spring 8*d*. The cleaning blade 8*a* is formed of rubber such as polyurethane rubber, and a silicone gum in the shape of a plate. The edge of the cleaning blade 8*a* abuts with the surface of the photoconductor 1, and removes toners remaining on the photoconductor after transfer. The cleaning blade 8*a* is supported by the supporting member 8*b* which can be made of metals, plastics, ceramics, etc, and is installed at a predetermined angle to the surface of the photoconductor 1. In addition, the cleaning blade 8*a* is abutted to the surface of photoconductor 1 by the blade pressure spring 8*d* with a predetermined contact pressure and the amount of inroad (i.e., the area of deformation of the cleaning blade surface created when the cleaning blade abuts the photoconductor).

The lubricant applying device 3 is disposed on the downstream side from the point that the photoconductor 1 opposes the first transfer roller 51, and on the upstream side from the cleaning device 8 with respect to the rotational direction of the photoconductor 1. The cleaning blade 8*a* spreads the lubricant, which is applied by the lubricant applying device 3 to the surface of the photoconductor 1, in a thin film on the surface of the photoconductor 1. The lubricant applying device 3 is preferably provided next to the cleaning device 8. In this case, toners remaining on the photoconductor 1 attach to the brush when the brush abrades the photoconductor 1. Then, the toners attached to the brush are removed by a flicker (not shown) or the solid lubricant 3*b* and transferred for collection by a toner collecting coil 8*c* with the toner collected by the cleaning blade 8*a*.

Figure 3A:
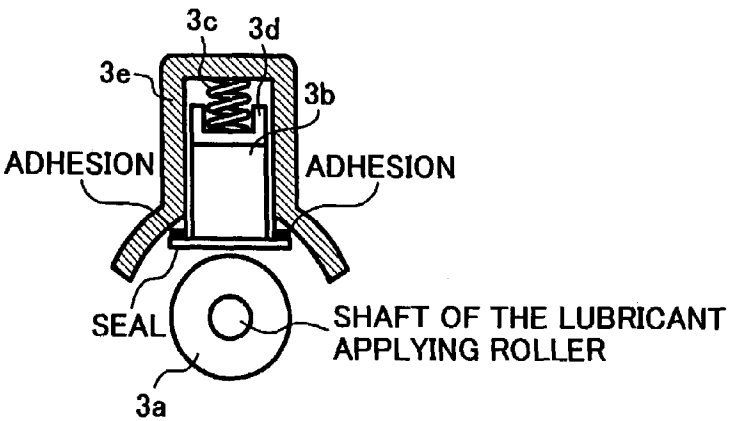
FIGS. 3A and 3B illustrate an exemplary structure of a lubricant application device.
Figure 3B:
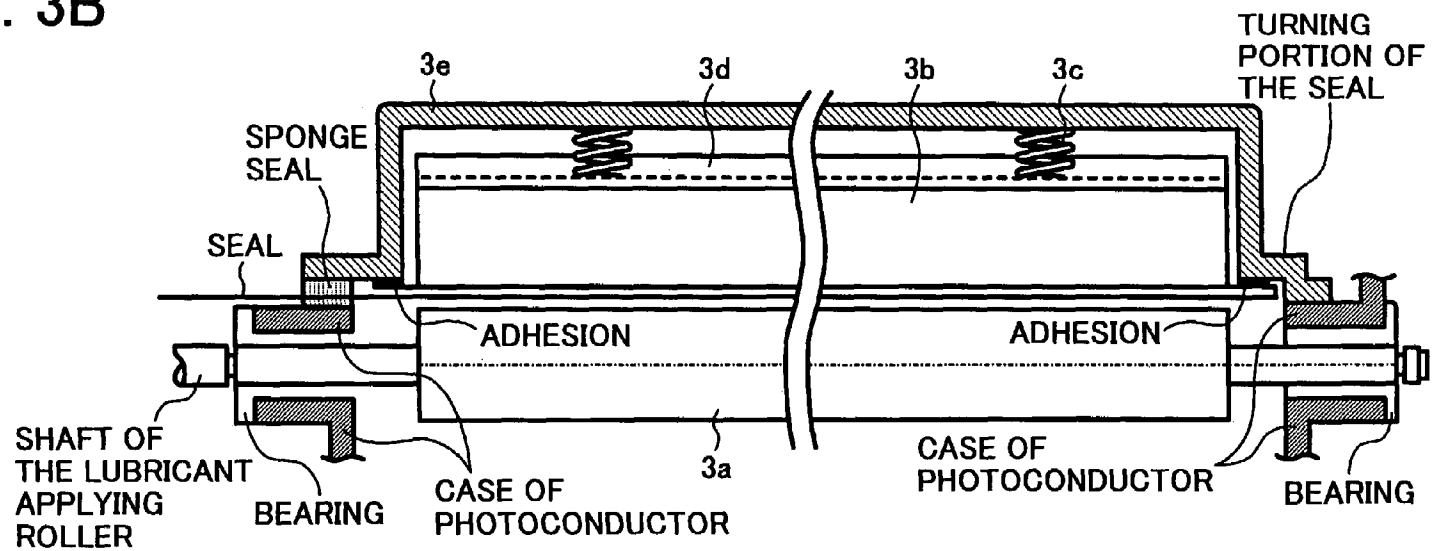

The lubricant applying device 3 is described below in more detail. FIGS. 3*a* and 3*b* illustrate a constitution of the lubricant case 3*e* of the lubricant applying device 3. FIG. 3*b* is a longitudinal representation of the lubricant case 3*e*. FIG. 3*a* is a cross section of FIG. 3*b* showing the lubricant case 3*e*.

The solid lubricant 3*b* preferably includes a fatty acid metal salt, or fluorinated resin. For example, fatty acids of a straight-chain hydrocarbon such as myristic acid, palmitic acid, stearic acid, or oleic acid can be used. Lithium, magnesium, calcium, strontium, zinc, cadmium, aluminum, cerium, titanium, iron can be used as the metal. Of these materials, stearic acid zinc, stearic acid magnesium, stearic acid aluminum, stearic acid iron are the preferred fatty acid metal salts, and stearic acid zinc is particularly preferable.

The fluorinated resin is a synthetic high polymer containing a fluorine atom in a molecule. Normally, polytetrafluoroethylene (4 fluorinated ethylene resin: PTFE), tetrafluoroethylene-par fluoroalkyl vinyl ether copolymer (4 fluorinated ethylene par fluoro alkoxide ethylene copolymerization resin: PFA), tetrafluoroethylene-hexafluoropropylene copolymer (4 fluorinated ethylene 6 fluorinated propylene copolymerization resin: FEP), tetrafluoroethylene-ethylene copolymer (4 fluorinated ethylene ethylene copolymerization resin: E/TFE), polyvinylidene fluoride (vinylidene fluoride resin: PVDF), a polychlorotrifluoroethylene (3 fluorinated chloride ethylene resin: PCTFE), chlorotrifluoroethylene-ethylene copolymer (3 fluorinated chloride ethylene ethylene copolymerization resin: E/CTFE), tetrafluoroethylene-par fluorodimethyldioxisole copolymerization resin (TFE/PDD), or polyvinyl fluoride (fluorinated vinyl resin: PVF) are used as the solid lubricant 3*b*.

As shown in FIGS. 3*a* and 3*b*, when the solid lubricant 3*b* is a fatty acid metal salt, such as described above in the molded shape of a rectangular solid, the solid lubricant 3*b* is fixed in a lubricant hold member 3*d*. Plural pressure applying members 3*c* bias the solid lubricant 3*b* to the brush roller 3*a* provided longitudinally in the lubricant hold member 3*d*. The solid lubricant is generally adhered to a lubricant hold member (reinforcement use) of a metal plate with double-stick tape configured not to be broken by shocks created during use. The lubricant hold member 3*d* is attached to the pressure applying spring 3*c*, and is inserted in a lubricant case 3*e*. When using a weight as a pressure member, the spring is unnecessary.

A seal member is bonded in four directions of the lubricant case 3*e* so that the lubricant 3*b* enters the lubricant case 3*e* to the depths of the lubricant case 3*c* (i.e., the springs 3*c* are compressed), and the lubricant 3*b* is sealed in the lubricant case 3*e*. The lubricant case 3*e* can be used as an exchange (service) part. The seal member has a length more than two times that of the lubricant. The lubricant case 3*e* is attached to a frame of a process cartridge in a state such that the seal member is turned down in a rear portion (the right side of FIG. 3(*b*)).

When the lubricant case 3*e* is attached to the frame of the process cartridge, because the lubricant is inserted to the depths of the lubricant case 3*e*, a treatment of the lubricant is easily completed without touching the lubricant. As a consequence of the configuration shown in FIGS. 3*a* and 3*b*, the lubricant 3*b* is sealed in the lubricant case 3*e* and has no contact with the lubricant applying brush roller 3*a*. The seal member extends between a sponge seal attached to the lubricant case 3*e* and a case of the process cartridge (see the left side of FIG. 3(*b*)). When a user receives the lubricant case, the adhesion with the lubricant case 3*e* comes off from the lubricant case 3*c* position to the process cartridge position by pulling the seal member. The lubricant 3*b* is opened by pulling the seal member, and is positioned adjacent to the lubricant applying brush roller 3*a* by applying pressure using a spring or a weight. When a new lubricant is provided as an exchange (service) part, the seal is pulled using a similar procedure.

As for the pressure application power applied by the pressure applying member 3*c* to the solid lubricant 3*b*, a total pressure application power of plural pressure applying members 3*c* is in a range of 200-1000 mN. When the total pressure of pressure application power is less than 200 mN, the quantity of lubricant applied to the surface of the photoconductor 1 is insufficient because the lubricant 3*b* is not sufficiently applied to the brush roller 3*a*. Under that condition, abrasion of the cleaning blade 8*a* and the surface of the photoconductor 1 is promoted, and poor cleaning of toner (e.g., toner remaining after transfer) often occurs. In addition, the quantity of lubricant applied to the surface of the photoconductor 1 becomes excessive when the total pressure is beyond 1000 mN. This condition results in the rapid consumption of the solid lubricant 3*b*. In addition, the surface of the photoconductor 1 is affected by humidity because this condition results in the lubricant consisting of hygroscopic fatty acid metal salts which can factor in the flow of an electrostatic latent image and result in an unclear picture. Thus, the solid lubricant 3*b* is preferably applied to the brush roller 3*a* using a total pressure between 200-1000 mN.

As for the thickness of brush fibers of the brush roller 3*a*, 3-8 deniers are preferable, and as for the density of brush fibers, 20,000-100,000 per sq. in. is preferable. When the thickness of the brush fibers is too thin, the fibers of brush roller 3*a* easily dislodge and abut with the surface of photoconductor 1. On the other hand, when the thickness of the brush fibers is too thick, it is difficult to increase the density of fibers.

In addition, when the density of the brush fibers is low, it is difficult to apply uniformly the lubricant to the surface of the photoconductor 1 because of the low number of brush fibers abutting with the surface of the photoconductor. In contrast, when the density of the brush fibers is too high, the quantity of application is relatively reduced because the spacing between fibers is reduced and the adhesion quantity of lubricant powder decreases. Thus, the above described range of the density and thickness of the brush fibers of the brush roller 3*a* are set to prevent the brush fibers from falling off and to perform an effective uniform application of the lubricant.

As shown in FIG. 2, the brush roller 3*a* is preferably rotated in a direction identical to the rotating direction of the photoconductor 1 in contact with the brush roller 3. With the rotation occurring in this direction, the lubricant attached to the brush roller 3*a* can be supplied to the photoconductor 1 with little impact. Consequently, the brush roller 3*a* is preferably rotated in the direction identical to the rotating direction of the photoconductor 1.

An appropriate quantity of lubricant is applied to the surface of photoconductor 1 by the lubricant applying device 3 having a constitution such as described above. In addition, a uniform film of a lubricant can be formed without producing an uneven application. As a consequence of this embodiment, abrasion of the cleaning blade 8*a* and the surface of the photoconductor 1 can be prevented, and the transfer of cleaning toners or the like to the surface of photoconductor 1 can be performed well. In addition, prevention of an unclear picture induced by the surface of the photoconductor 1 being affected by the humidity by excessive application pf the lubricant can be accomplished.

The friction factor of the photoconductor 1 is measured by the Oiler belt method. The measuring method is as follows: stretch a quality paper of a medium thickness serving as a belt in the longitudinal direction over one quarter of the circumference of the photoconductor drum 1; attach a force gauge to one side of the belt and a weight of, for example, 100 gr to the other side thereof to pull the force gauge; increase the weight until the belt moves; read the value of the gauge when the belt moves; and calculate the static friction factor using the following relationship:$\mu s=2/p\times\ln(F/W)$, where $\mu s$ is the static friction factor, F is the measured value, and W is the weight.

When the static friction factor of photoconductor 1 is determined to be lower than 0.4 using the Oiler belt method, it is understood that the photoconductor 1 is likely too abrasive. Therefore, it is preferable to decrease the static friction factor of the photoconductor to under 0.4. However, the static friction factor of the photoconductor does not always have to be maintained under 0.4. When the quantity of the abrasion is controlled, the static friction factor of the photoconductor is permitted temporarily to exceed 0.4. In addition, the static friction factor of the photoconductor can be controlled to be between 0.1 and 0.3 when a more effective area of abrasion is realized. In this case, it is observed that the quantity of abrasion decreases. The lower limit of the static friction factor of the photoconductor can be set dependent on the environmental condition.

In addition, the lubricant applying device 3 can be used not only as a lubricant applying device for the surface of the photoconductor, but also, for example, as a lubricant applying device for the surface of an intermediate transfer belt 56 as shown in FIG. 1. In this case, the lubricant applying device 3 can be provided adjacent to the intermediate transfer belt cleaning unit 57 or included in the intermediate transfer belt cleaning unit 57. The lubricant applying device 3 is disposed in the upstream side from the intermediate transfer belt cleaning unit 57 with respect to the rotational direction of the intermediate transfer belt cleaning unit 57. The cleaning blade disposed adjacent the intermediate transfer belt cleaning unit 57 spreads the lubricant applied to the surface of the intermediate transfer belt 56 in a thin film on the surface of the intermediate transfer belt 56. As a consequence of this embodiment, incrustations such as toners remaining on the surface of the intermediate transfer belt 56 which are not transferred at a nip created with the second transfer roller 61 can be cleaned well.

The lubricant applying device 3 described above can be used not only for an image forming apparatus, but also for a process cartridge which is detachable from the image forming apparatus and which includes at least a photoconductor 1 (optionally provided with one or more devices such as the charging device 2, the developing device 4, and the cleaning device 8.)

As described above when the lubricant applying device 3 is used together with the cleaning device 8, the lubricant applying device 3 is disposed on the upstream side from the cleaning device 8 with respect to the rotational direction of the photoconductor 1. This process cartridge maintains a long term cleaning performance of the surface of the photoconductor 1. Moreover, the process cartridge prevents deterioration of a picture.

This embodiment is more effective when a toner having a small diameter and spherical shape is used. It is preferred to use in the developing device 5 a toner having a volume average particle diameter (Dv) from 3 to 8 μm and a ratio (Dv/Dn) of the volume average particle diameter (Dv) to the number average particle diameter (Dn) from 1.00 to 1.40.

By using a toner having a small particle diameter, the toner can be adhered to the photoconductor more accurately. However, when the volume average particle diameter of the toner is smaller than the preferred range, the toner in a double component developing device will melt and adhere over a long term to the surface of a magnetic carrier due to agitation and result in the deterioration of the electricity charging ability of the magnetism carrier. Further, the toner in the single component developing device will adhere to the developing roller as a film, and subsequently melt and adhere to a blade such as a toner layer thinning blade. In contrast thereto, when the volume average particle diameter of the toner is larger than the preferred range, it becomes difficult to obtain high-resolution and high quality pictures, and fluctuation of particle size of the toner increases.

Further, by using a toner having a sharp particle diameter distribution, the toner charge distribution can be made uniform. Moreover, it becomes possible to obtain high quality pictures having less pollution on the picture surface and high transfer rate. When the ratio (Dv/Dn) is larger than 1.40, the toner charge distribution is wide and quality images may be difficult to obtain.

The particle diameter of a toner can be measured using a COULTER COUNTER TA-II or a MULTI-SIZER II (manufactured by Beckman Coulter, Inc.) device. In this embodiment, the distribution of toner number and distribution of toner volume is analyzed by the COULTER COUNTER TA-II which is connected to an Interface (manufactured by Nikka-giken Corporation) and a personal computer (PC9801: manufactured by NEC Corporation).

The ratio of wax (which is added inside or outside the toner to improve the toner release characteristics) and inorganic particles (which are added to improve the toner fluidity) to toner of the above described embodiment is higher than the ratio of background toner because of the small diameter toner. Moreover, these additives should be factored when producing adhesive materials on photoconductor 1. Thus, by being equipped with lubricant applying device 3 of the present invention, it is possible to provide a uniform lubricant film over the surface of the photoconductor 1, and to reduce the adhesive power of these adhesive materials to the surface of the photoconductor 1. In addition, it is possible to reduce the frictional force between the surface of the photoconductor 1 and cleaning blade 7*a* of cleaning device 7 such that the cleaning can be performed at a high level.

Figure 4A:
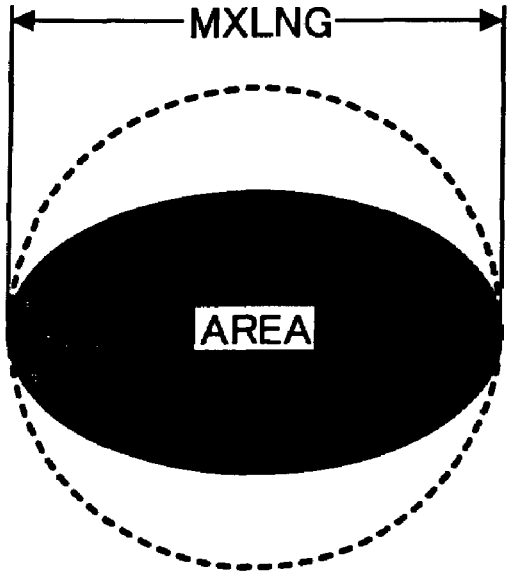
FIGS. 4A and 4B are schematic views showing exemplary toner shapes for the purpose of explaining shape coefficients SF-1 and SF-2.
Figure 4B:
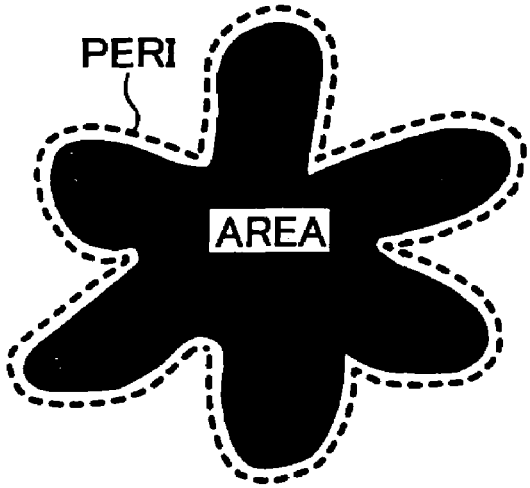

The toner for use in the developing device 5 preferably has a form having a form factor SF-1 of from 100 to 180, and a form factor SF-2 of from 100 to 180 with regard to circularity. FIG. 4A and FIG. 4B show the form factor SF-1 and SF-2 of the toner particles. As shown in FIG. 4A, the form factor SF-1 is the degree of roundness of a toner particle and is defined by the following equation:

$$SF\text{-}1=((MXLNG)2/(AREA))\times(100p/4) \quad (1)$$

where MXLNG is a maximum diameter of the circle circumscribing the image of a toner particle obtained, for example, by observing the toner particle with a microscope, and AREA is the area of the image. When the SF-1 is 100, the toner particle is a true sphere. When SF-1 increases, the toner form transforms away from a true sphere form.

As illustrated in FIG. 4B, the form factor SF-2 is the degree of concavity and convexity of a toner particle and is defined by the following equation:

$$SF\text{-}2=((PERI)2/(AREA))\times(100p/4) \quad (2)$$

where PERI is the peripheral length, or perimeter, of the image of a toner particle observed, for example, by a microscope; and AREA is the area of the image. When the SF-2 is 100, the surface of the toner particle does not have any concavity or convexity. When SF-2 increases, the toner surface becomes rough.

When the toner has a form close to a true sphere, the contact between toner particles is point to point. Thus, the adhesion force between toner particles weakens and therefore the toner has good fluidity. In addition, the adhesion force between the toner and the photoconductor 1 is also weak and the transfer rate of the toner is high. On the other hand, because the sphere toner easily enters the gap between the cleaning blade 7*a* and the photoconductor 1, it is preferred that the form factors SF-1 and SF-2 be moderately large.

Further, when the form factors SF-1 and SF-2 are large, the toner is scattered on the image resulting in deterioration of the quality of images. Therefore, it is preferred that SF-1 and SF-2 both be no greater than 180.

The form factors SF-1 and SF-2 are determined by the following method:

(1) a photograph of particles of a toner is taken using a scanning electron microscope (S-800, manufactured by Hitachi Ltd.); and (2) particle images of 100 toner particles are analyzed using an image analyzer (LUSEX 3 manufactured by Nireco Corp.).

A toner that can be used favorably in the image forming apparatus of this embodiment is one obtained by dissolving or dispersing at least a polyester prepolymer having a nitrogen atom-containing functional group, a polyester, a colorant, and a parting agent in an organic solvent, and subjecting the resulting toner material liquid to a crosslinking and/or extension reaction in an aqueous solvent. The materials constituting the toner, and the method for manufacturing the toner, will now be described.

Modified Polyester

Toner according to an embodiment of the present invention includes modified polyester (i) as a binder resin. As the modified polyester (i), the polyester resin may include a bond group other than an ester bond. Also, in the polyester resin, different resin constituents may be covalent and/or ion bonded to each other. Specifically, the modified polyester may result from modification of polyester residues by introducing a functional group such as an isocyanate group reacted with a hydroxyl group and a carboxylic acid group to polyester residues and further reacting the resulting compound with an active hydrogen including compound.

The modified polyester (i) may be urea-modified polyester generated by reaction of polyester prepolymer (A) having an isocyanate group and an amine class (B). The polyester prepolymer (A) having an isocyanate group may be generated by reacting polyester, which is a polycondensation compound of polyalcohol (PO) and polycarboxylic acid (PC) and includes polyester having an active hydrogen group, to a polyisocyanate (PIC) compound. Such an active hydrogen group of the polyester may be a hydroxyl group (alcoholic-hydroxyl group and phenolic-hydroxyl group), an amino group, a carboxyl group, and a mercapto group. Among these groups, the alcoholic-hydroxyl group is preferred.

The urea-modified polyester is generated as follows. A polyalcohol (PO) compound may be divalent alcohol (DIO) and tri- or more valent polyalcohol (TO). Only DIO or a mixture of DIO and a small amount of TO is preferred. The divalent alcohol (DIO) may be alkylene glycol (ethylene glycol, 1,3-propylene glycol, 1.4-butanediol, 1,6-hexanediol or the like), alkylene ether glycol (diethylene glycol, triethylene glycol, dipropyrene glycol, polyethylene glycol, polypropylene glycol, polytetramethylene ether glycol or the like), alicyclic diol (1,4-cyclohexane dimethanol, hydrogenated bisphenol A or the like), bisphenols (bisphenol A, bisphenol F, bisphenol S or the like), alkylene oxide adducts of above-mentioned alicyclic diols (ethylene oxide, propylene oxide, butylene oxide or the like), or alkylene oxide adducts of the above-mentioned bisphenols (ethylene oxide, propylene oxide, butylene oxide or the like).

Alkylene glycol having 2-12 carbon atoms and alkylene oxide adducts of bisphenols are preferred. In particular, the alkylene glycol having 2-12 carbon atoms and the alkylene oxide adducts of bisphenols are preferably used together. Tri- or more valent polyalcohol (TO) may be tri- to octa or more valent polyaliphatic alcohols (glycerin, trimethylolethane, trimethylol propane, pentaerythritol, sorbitol or the like), tri- or more valent phenols (trisphenol PA, phenol novolac, cresol novolac or the like), and alkylene oxide adducts of tri- or more valent polyphenols.

The polycarboxylic acid (PC) may be divalent carboxylic acid (DIC) and tri- or more valent polycarboxylic acid (TC). Only DIC or a mixture of DIC and a small amount of TC is preferred. The divalent carboxylic acid (DIC) may be alkylene dicarboxylic acid (succinic acid, adipic acid, sebacic acid or the like), alkenylene dicarboxylic acid (maleic acid, fumaric acid or the like), and aromatic dicarboxylic acid (phthalic acid, isophthalic acid, terephthalic acid, naphthalene dicarboxylic acid or the like). Alkenylene dicarboxylic acid having 4-20 carbon atoms and aromatic dicarboxylic acid having 8-20 carbon atoms are preferred. Tri- or more valent polycarboxylic acid may be aromatic polycarboxylic acid having 9-20 carbon atoms (trimellitic acid, pyromellitic acid or the like). Here, the polycarboxylic acid (PC) may be reacted to the polyalcohol (PO) by using acid anhydrides or lower alkyl ester (methylester, ethylester, isopropylester or the like) of the above-mentioned materials.

A ratio of the polyalcohol (PO) and the polycarboxylic acid (PC) is normally set between 2/1 and 1/1 as an equivalent ratio [OH]/[COOH] of a hydroxyl group [OH] and a carboxyl group [COOH]. The ratio preferably ranges from 1.5/1 through 1/1. In particular, the ratio is preferably between 1.3/1 and 1.02/1.

A polyisocyanate (PIC) compound may be aliphatic polyisocyanate (tetramethylene diisocyanate, hexamethylene diisocyanate, 2,6-diisocyanate methylcaproate or the like), alicyclic polyisocyanate (isophoron diisocyanate, cyclohexyl methane diisocyanate or the like), aromatic diisocyanate (trilene diisocyanate, diphenylmethane diisocyanate or the like), aromatic aliphatic diisocyanate (a, a, a', a'-tetramethyl xylylene diisocyanate), isocyanates, materials blocked against the polyisocyanate with phenol derivative, oxime, caprolactam or the like, and combinations of two or more of these materials.

The ratio of the polyisocyanate (PIC) compound is normally set between 5/1 and 1/1 as an equivalent ratio [NCO]/[OH] of the isocyanate group [NCO] and the hydroxyl group [OH] of polyester having a hydroxyl group. The ratio is preferably between 4/1 and 1.2/1. In particular, the ratio is preferably between 2.5/1 and 1.5/1. If the ratio [NCO]/[OH] is greater than or equal to 5.0, the ratio degrades low temperature fixability. If the mole ratio of [NCO] is less than or equal to 1.0, ester of urea-modified polyester includes a smaller amount of urea, thereby resulting in degraded hot offset proof.

Polyester prepolymer (A) having an isocyanate group normally includes 0.5 through 40 wt % (part by weight) of polyisocyanate (PIC) compound components. It is preferable that the contained amount be between 1 and 30 wt %. In particular, the amount is preferably between 2 and 20 wt %. If the contained amount is less than 0.5 wt %, the hot offset proof is degraded, and additionally heat-resistant storage capability and low temperature fixability become poor. On the other hand, if the contained amount is larger than or equal to 40 wt %, the low temperature fixability is degraded.

For each molecule of polyester prepolymer (A) having isocyanate groups, one or more isocyanate groups are normally contained. Preferably, the average number of contained isocyanate groups is between 1.5 and 3.0. Further preferably, the average number is between 1.8 and 2.5. If each molecule of polyester prepolymer (A) contains less than one isocyanate group, the molecular weight of urea-modified polyester becomes lower and the hot offset proof is degraded.

Amines (B) which react with polyester prepolymer (A) may be a divalent amine compound (B1), a tri- or more valent polyamine compound (B2), amino alcohol (B3), amino mercaptane (B4), amino acid (B5), B1 to B5 compounds which amino groups are blocked (B6), or the like.

The divalent amine compound (B1) may be aromatic diamine (phenylene diamine, diethyltoluene diamine, 4,4'-diaminodiphenyl methane or the like), alicyclic diamine (4,4'-diamino-3,3'-dimethyldicyclohexylmethane, diamine cyclohexane, isophoron diamine or the like), and aliphatic diamine (ethylene diamine, tetramethylene diamine, hexamethylene diamine or the like). The tri- or more valent polyamine compound (B2) may be diethylene triamine, triethylene tetramine or the like. The amino alcohol (B3) may be ethanol amine, hydroxyethyl aniline or the like. The amino marcaptane (B4) may be aminoethyl mercaptan, aminopropyl mercaptan, or the like. The amino acid (B5) may be amino propioic acid, amino caproic acid or the like. The B1 to B5 compounds which amino groups are blocked (B6) may be ketimine compounds and oxazolidine compounds which can be obtained from the amines and ketones (acetone, methylethyl ketone, methylisobutyl ketone or the like) of B1 through B5. The amines (B) are preferably B1 and a mixture of B1 and a small amount of B2.

The ratio of amines (B) is normally set between 1/2 and 2/1 as an equivalent ratio [NCO]/[NHx] of isocyanate groups [NCO] in polyester prepolymer (A) having isocyanate groups to amino groups [NHx] in amines (B). Preferably, the ratio is between 1.5/1 and 1/1.5. Further preferably, the ratio is between 1.2/1 and 1/1.2. If the ratio is greater than 2 or less than 1/2, the molecular weight of urea-modified polyester is lowered and the hot offset proof is degraded.

Modified polyester (i) for an image forming apparatus according to an embodiment of the present invention can be manufactured in accordance with a one-shot method or prepolymer method. The weight-average molecular weight of the modified polyester (i) is normally greater than 10,000. Preferably, the weight-average molecular weight is between 20,000 and 10,000,000. Further preferably, the weight-average molecular weight is between 30,000 and 1,000,000. The peak molecular weight is preferably between 1,000 and 10,000. If the peak molecular weight is less than 1,000, an elongation reaction less likely occurs and the toner has smaller elasticity. As a result, the hot offset proof is degraded. On the other hand, if the peak molecular weight is greater than 10,000, the fixability is lowered, and it becomes more difficult to properly manufacture the toner in the matter of particle formation and pulverization. The number-average molecular weight of the modified polyester (i), if unmodified polyester (ii) is used, is not limited. The modified polyester (i) may have any number-average molecular weight such that the weight-average molecular weight can be within the above-mentioned range. If only the modified polyester (i) is used, the number-average molecular weight is normally set as less than 20,000. Preferably, the number-average molecular weight is set between 1,000 and 10,000. Further preferably, the number-average molecular weight is between 2,000 and 8,000. If the number-average molecular weight is larger than 20,000, the low temperature fixability and the brightness for a full-color device are degraded.

In a bridge reaction and/or elongation reaction of polyester prepolymer (A) and amines (B), which is for generating modified polyester (i), a reaction terminating agent may be used as needed to adjust the molecular weight of obtained urea-modified polyester. Such a reaction terminating agent may be monoamine (diethylamine, dibutylamine, butylamine, lauryl amine or the like), and compounds thereof which amines are blocked compounds (ketimine compounds).

Unmodified Polyester

In the present invention, although only the modified polyester (i) can be used as described above, unmodified polyester (ii) together with the modified polyester (i) can be contained as a binder resin constituent. When the unmodified polyester (ii) is used together, it is possible to achieve better low temperature fixability and brightness for a full-color device than those obtained for use of only the modified polyester. The unmodified polyester (ii) may be polycondensation compounds of polyalcohol (PO) and polycarboxylic acid (PC) as in the above-mentioned polyester components of the modified polyester (i). The same materials as those of the modified polyester (i) are preferred. Also, the unmodified polyester (ii) may be compounds modified in chemical bonding other than urea bonding as well as unmodified polyester. For example, the polyester is modified in urethane bonding. It is preferable that at least a portion of both the modified and unmodified polyester (i) and (ii) is dissolved in terms of low temperature fixability and hot offset proof. Accordingly, the modified and unmodified polyester (i) and (ii) preferably have similar polyester compositions. If the unmodified polyester (ii) is included, the weight ratio of the modified polyester (i) to the unmodified polyester (ii) is normally set between 5/95 through 80/20. Preferably, the weight ratio is between 5/95 and 30/70. Moreover preferably, the weight ratio is between 5/95 and 25/75. In particular, the weight ratio is preferably between 7/93 and 20/80. If the weight ratio is less than 5%, the hot offset proof is degraded, and additionally the heat-resistant storage capability and the low temperature fixability become poor.

The peak molecular weight of the unmodified polyester (ii) is normally set between 1,000 and 10,000. Preferably, the peak molecular weight is between 2,000 and 8,000. Moreover preferably, the peak molecular weight is between 2,000 and 5,000. If the peak molecular weight is less than 1,000, the heat-resistant storage capability is degraded. On the other hand, if the peak molecular weight is greater than 10,000, the low temperature fixability is degraded. Also, the unmodified polyester (ii) has penta—or more valent hydroxyl groups. Moreover preferably, 10 through 120 valent hydroxyl groups are preferred. In particular, 20 through 80 valent hydroxyl groups are preferred. If the unmodified polyester (ii) has tetra—or less valent hydroxyl groups, the unmodified polyester (ii) is not preferred in terms of both the heat-resistant storage capability and the low temperature fixability. It is preferable that the acid value of the unmodified polyester be between one and five. Moreover preferably, the acid number is within two through four. Since high acid value wax is used, and low acid value binder is linked to electrification and high volume resistance, such unmodified polyester (ii) is suitable for toner used as a binary developer.

A glass transition point (Tg) of binder resin is normally set to be within 35 through 70° C. Preferably, Tg is within 55 through 65° C. If Tg is less than 35° C., the heat-resistant storage capability is degraded. On, the other hand, if Tg is greater than 70° C., the low temperature fixability becomes insufficient. Urea-modified polyester is likely to be on the surfaces of obtained toner parent body particles. Accordingly, toner according to an embodiment of the present invention, even if the glass transition point is low, tends to show better heat-resistant storage capability than known polyester toner does.

Colorant

All known dyes and pigments are available as a colorant of toner according to an embodiment of the present invention. For example, such a colorant mat be carbon black, nigrosine dye, iron black, naphtol yellow-S, Hansa yellow (10G, 5G, G), cadmium yellow, yellow oxide, ocher, chrome yellow, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazine lake, quinoline yellow lake, anthrazane yellow BGL, isoindolinone yellow, colcothar, minium, lead vermilion, cadmium red, cadmium mercury red, antimony vermilion, permanent red 4R, para red, para-chloro-ortho-nitroaniline red, lithol fast scarlet G, brilliant fast scarlet, brilliant carmine BS, permanent red (F2R, F4R, FRL, FRLL, F4RH), fast scarlet VD, brilliant scarlet G, lithol rubin GX, permanent red F5R, brilliant carmine 6B, pigment scarlet 3B, bordeaux 5B, toluidine maroon, permanent bordeaux F2K, helio bordeaux BL, bordeaux 10B, BON marron light, BON marron medium, eosine lake, rhodamine lake B, rhodamine lake Y, alizarine lake, thioindigo red B, thioindigo maroon, oil red, quinacridone red, pyrazolone red, polyazo red, chrome vermilion, benzidine orange, perynone orange, oil orange, cobalt blue, cerulean blue, alkali blue lake, peacock blue lake, Victoria blue lake, no metal-containing phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, viridian, emerald green, pigment green B. naphthol green B, green gold, acid green lake, malachite green lake, phthalocyanine green, anthraquinone green, titanium oxide, zinc white, Litobon and mixtures thereof. The containing amount of a colorant in toner is normally set between 1 and 15 weight percent. Preferably, the containing amount is between 3 and 10 weight percent.

A colorant may be used as masterbatch combined with resin. Such masterbatch may be manufactured from or mixed as binder resin together with: polystyrene, poly-p-chlorostyrene, styrenes such as polyvinyltoluene and substituted polymer thereof, copolymer of the above-mentioned compounds and vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butylal, polyacrylate resin, rosin, modified rosin, terpene resin, aliphatic or alicyclic hydrocarbon resin, aromatic petroleum resin, chlorinated paraffin, paraffin wax or the like. These materials can be used as a single material or a compound thereof.

Charge Control Agent

In the present invention, existing charge control agents are available. For example, the charge control agent may be nigrosin dye, triphenylmethane dye, chrome-containing metal complex dye, moribdate-chelated pigment, rhodamine dye, alkoxy amine, quaternary ammonium salt (including fluoride-modified quaternary ammonium salt), alkylamide, phosphorous or phosphorous-containing compounds, tungsten or tungsten-containing compounds, fluorinated active agent, metal salicylate, salicylate derivative metal salts or the like. Specifically, the charge control agent may be nigrosin dye BONTRON 03, quaternary ammonium salt BONTRON-P-51, metal-containing azo dye BONTRON S-34, oxynaphthate metal complex E-82, salicylate metal complex E-84, phenolic condensate E-89 (which are produced by Orient Chemical Industries Ltd.), molybdenum complex with quaternary ammonium salt TP-302 and TP-415 (which are produced by Hodogaya Chemical Co., Ltd.), quaternary ammonium salt copy charge PSY VP2038, triphenylmethane derivatives copy blue PR, quaternary ammonium salt copy charge NEG VP2036, copy charge NX VP434 (which are produced by Hoechst), LRA-901, boron complex LR-147 (which are produced by Japan Carlit Co., Ltd.), copper phthalocyanine, perylene, quinacridone, azo pigment, and high-molecular-weight-compounds having sulfonyl, carboxyl, or quaternary ammonium salt group. In particular, materials that can control toner to have negative polarity are preferably used.

The use amount of the charge control agent is determined depending on types of binder resin, presence of additives used as needed, and toner manufacturing methods including a dispersion method, and therefore cannot be not uniquely determined. However, the charge control agent is normally used within a weight part of 0.1 through 10 for the weight part 100 of binder resin. Preferably, the charge control agent is within a weight part of 0.2 through 5. If the weight is above 10, toner particles are electrified too much. As a result, the charge control agent becomes less effective, resulting in increasing electrostatic suction power with a developing roller, decreasing fixability of developer, and lowered image density.

Release Agent

Low melting point waxes, for example which have a melting point of 50 through 120° C., are available as a release agent. Such low melting point waxes effectively work as a release agent between a fixing roller and a toner boundary in dispersion with binder resin. Thereby, it is possible to realize effective high temperature offset without applying a release agent, such as oil, on the fixing roller. Such waxes may have the following constituents. Brazing filler metal and waxes may include waxes derived from plants, such as carnauba, cotton brazing filter metal, wood brazing filter metal, rice brazing filter metal, waxes derived from animals, such as yellow beeswax and lanolin, waxes derived from mineral substances, such as ozokerite and cercine, and petroleum waxes, such as paraffin wax, microcrystalline, and petrolatum. Apart from these natural waxes, synthesized hydrocarbon waxes, such as Fischer-Tropsch wax and polyethylene wax, and synthesized wax, such as ester, ketone and ether, may be used. In addition, aliphatic amide such as 12-hydroxystearate amide, amide stearate, imide phthalate anhydride and chlorinated hydrocarbon, crystalline polymer resin having low molecular weight homopolymer or copolymer such as poly-n-laurylmethacrylate and poly-n-stearylmethacrylate (for example, n-stearylacrylate-ethylmethacrylate copolymer), and crystalline polymer which side chain has long alkyl group may be used. A charge control agent and a release agent together with masterbatch and binder resin may be fused and mixed, and may be dissolved and dispersed in organic solvent.

External Additives

Specifically, such inorganic particles may be formed of silica, alumina, titanium oxide, barium titanate, magnesium titanate, calcium titanate, strontium titanate, zinc oxide, tin oxide, silica sand, clay, mica, wollatonite, diatomite, chromium oxide, cerium oxide, colcothar, antimony trioxide, magnesium oxide, zirconium oxide, barium sulfate, barium carbonate, calcium carbonate, silicon carbide, silicon nitride or the like. Among these materials, hydrophobic silica particles and hydrophobic titanium oxide particles are used together as an agent to provide flowability. In particular, when these particles having an average diameter of less than $5\times10^{-2}$ μm are mixed, an electrostatic force and Van der Waals force with toner particles are considerably improved. As a result, even if such external additives are mixed with toner particles in a developing device to achieve a desired electrification level, it is possible to obtain a firefly-free good image without desorption of a flowability accelerator agent from toner particles, and further reduce an amount of remaining toner after transferring.

While titanium oxide fine particles have high environmental stability and image density stability, the titanium oxide fine particles have an insufficient electrification start feature. As a result, if more titanium oxide fine particles are contained than silica fine particles, this adverse effect becomes more influential. However, if hydrophobic silica particles and hydrophobic titanium oxide particles are contained within 0.3 through 1.5 wt %, a desired electrification start feature is obtained without significant damage. In other words, even if an image is repeatedly copied, it is possible to achieve stable image quality for each copy.

Toner Manufacturing Method

Preferred embodiments of a toner manufacturing method according to the present invention are described herein. However, the present invention is not limited to these embodiments.

1) To produce toner material liquid, colorant, unmodified polyester, polyester prepolymer having isocyanate group, and a release agent are dispersed in organic solvent. From the viewpoint of removal after formation of toner source particles, it is preferable that the organic solvent be volatile and have a boiling point of less than 100° C. Specifically, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, methylisobutylketone, and compounds thereof are available. In particular, aromatic solvent such as toluene and xylene, and chlorinated hydrocarbon such as methylene chloride, 1,2-dichloroethane, chloroform and carbon tetrachloride, are preferred. For 100 w/t parts of polyester prepolymer, 0 through 300 w/t parts of organic solvent are normally used.

Preferably, 0 through 100 w/t parts are used. Further, 25 to 70 w/t parts are preferably used.

2) The toner material liquid together with a surface-active agent and resin fine particles is emulsified in aqueous solvent.

Such aqueous solvent may be water or organic solvent such as alcohol (methanol, isopropyl alcohol, ethylene glycol or the like), dimethyl formamide, tetrahydrofuran, cellosolves (methylcellosolve), lower ketones (acetone, methylethylketone or the like).

For 100 w/t parts of the toner material liquid, 50 through 2,000 w/t parts of aqueous solvent is normally used. The 100 through 1,000 w/t parts are preferred. If the part by weight of the aqueous solvent is less than 50, the toner material liquid is poorly dispersed, and thereby it is difficult to obtain toner particles having a predefined diameter. On the other hand, if the part by weight of the aqueous solvent is larger than 20,000, that is economically inefficient.

Further, for the purpose of good dispersion in aqueous solvent, a dispersion agent such as a surface-active agent and resin fine particles is added as needed. Such a surface-active agent may be alkylbenzene sulfonate salt, &agr;- olefin sulfonate salt, anionic surfactant such as phosphate ester, alkyl amine salt, aminoalcohol fatty acid derivatives, polyamine fatty acid derivatives, amine salt such as imidazoline, alkyltrimethyl ammonium salt, dialkyldimethyl ammonium salt, alkyldimethylbenzyl ammonium salt, pyridinium salt, alkylisoquinolinium salt, cationic surfactant quaternary ammonium salt such as benzethonium chloride, fatty amide derivatives, non-ionic surfactant such as multivalent alcohol derivatives, and amphoteric surfactant such as alanine, dodecyl (aminoethyl) glycine, di(octylaminoethyl) glycine, N-alkyl-N,N-dimethylammonium betaine.

Further, even if a small amount of a surface-active agent having a fluoroalkyl group is used, the surface-active agent works well. Preferred anionic surfactant having fluoroalkyl group may be fluoroalkylcarboxylic acid having 2-10 carbon atoms and metal salt thereof, disodium perfluorooctanesulfonyl glutamate, sodium 3-[&ohgr;- fluoroalkyl (C6-C11) oxy]-1-alkyl (C3-C4) sulfonate, sodium 3-[&ohgr;- fluoroalkanoyl (C6-C8) oxy]-N-ethylamino]-1-propane sulfonate, fluoroalkyl (C11-C20) carboxylic acid and metal salts thereof, perfluoroalkylcarboxylic acid (C7-C13) and metal salts thereof, perfluoroalkyl (C4-C12) sulfonic acid and metal salt thereof, perfluorooctanesulfonic acid diethanolamide, N-propyl-N-(2-hydroxyethyl)-perfluorooctanesulfonamide, propyltrimethylammonium salt of a perfluoroalkyl (C6-C10) sulfonamide, salt of perfluoroalkyl (C6-C10)-N-ethylsulfonylglycine, monoperfluoroalkyl (C6-C16) ethyl phosphate ester or the like.

Commercially, Surflon S-111, S-112 and S113 (which are produced by Asahi Glass Co., Ltd.), Florad FC-93, FC-95, FC-98 and FC-129 (which are produced by Sumitomo 3M Ltd.), Unidyne DS-101 and DS-102 (which are produced by Daikin Industry Ltd.), Megaface F-110, F-120, F-113, F-191, F-812 and F-833 (which are produced by Dainippon Ink and Chemicals, Inc.), Ektop EF-102, EF-103, EF-104, EF-105, EF-112, EF-123A, EF-123B, EF-306A, EF-501, EF-201 and EF-204 (which are produced by Tohkem products), and Ftergent F-100 and F-150 (which are produced by Neos) are available. Further, a cationic surfactant may be aliphatic primary or secondary amino acid having fluoroalkyl group, aliphatic quaternary ammonium salt such as ammonium salt of perfluoroalkyl (C6-C10) sulfonamide propyltrimethyl, benzalkonium salt, benzethonium chloride, pyridinium salt, imidazolinium salt, commercially, Surflon S-121, Florad FC-135, Unidyne DS-202, Megaface F-150 and F-824, Ektop EF-132, Ftergent F-300 or the like.

Resin fine particles are added to stabilize toner source particles formed in aqueous solvent. The resin fine particles are preferably added such that the coverage ratio thereof on the surface of a toner source particle can be within 10 through 90%. For example, such resin fine particles may be methyl polymethacrylate particles of 1 μm and 3 μm, polystyrene particles of 0.5 μm and 2 μm, poly(styrene-acrylonitrile)particles of 1 μm, commercially, PB-200 (which is produced by Kao Co.), SGP, SGP-3G (Soken), technopolymer SB (Sekisui Plastics Co., Ltd.), micropearl (Sekisui Chemical Co., Ltd.) or the like. Further, an inorganic dispersant such as calcium triphosphate, calcium carbonate, titanium oxide, colloidal silica, and hydroxyapatite may be used.

To make dispersed drops stable, polymer protective colloid may be used together with the above-mentioned resin fine particles and inorganic dispersant. For example, acid compounds such as acrylic acid, methacrylic acid, a-cyanoacrylic acid, a-cyanomethacrylic acid, itaconic acid, crotonic acid, fumaric acid, maleic acid and maleic anhydride, or (meth)acrylic monomer with a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, ester from diethylene glycol and monoacrylic acid, ester from diethylene glycol and monomethacrylic acid, ester from glycerin and monoacrylic acid, ester from glycerin and monomethacrylic acid, N-methylolacrylamide and N-methylolmethacrylamide, vinyl alcohol or ethers from vinyl alcohol such as vinylmethyether, vinylethylether and vinylpropylether, esters from vinylalcohol and compound having carboxylic group such as vinyl acetate, vinyl propionate and vinyl lactate, acrylamide, methacrylamide, diacetoneacrylamide or methylol compounds thereof, acid chlorides such as acryloyl chloride and methacrylate chloride, nitrogen-containing compounds such as vinylpyridine, vinylpyrrolidone, vinylimidazol and ethyleneimine, homopolymer or co-polymer having heterocycles thereof, polyoxyethylene-based ones such as polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene laurylphenyl ether, polyoxyethylene stearyl phenyl ester and polyoxyethylene nonyl phenyl ester, and celluloses such as methyl cellulose, hydroxyethyl cellulose and hydroxypropyl cellulose, are available.

The present invention is not limited to any certain dispersion method. Well-known techniques, such as low-speed shred type, high-speed shred type, friction type, high-pressure jet type and ultrasonic type, are available. In particular, the high-speed shred type dispersion apparatus is preferred to obtain dispersed particles having a diameter of 2 through 20 μm. If such a high-speed shred type dispersion apparatus is used, the rotation speed is not limited. However, the rotation speed is normally set within 1,000 through 30,000 rpm. Preferably, the rotation speed is within 5,000 through 20,000 rpm. Further, although the dispersion time is not limited to a certain time period, the dispersion time is normally set within 0.1 through 5 minutes for a batch method. The temperature during dispersion is normally kept between 0 and 150° C. (under pressure). Preferably, the temperature is kept between 40 and 98° C.

3) During production of emulsion liquid, amines (B) are added to react with polyester prepolymer (A) having isocyanate group. This reaction involves bridge and/or elongation of molecule chain. The reaction time is determined depending on reactivity of the structure of the isocyanate group of the polyester prepolymer (A) and the amines (B). The reaction time is normally set between 10 minutes and 40 hours. Preferably, the reaction time is set between 2 and 24 hours. In addition, existing catalysts may be used as needed. Specifically, dibutyl tin laurate, dioctyl tin laurate or the like are available.

4) After completion of the reaction, organic solvent is removed from the emulsified dispersed reactant, and subsequently the resulting material is cleaned and dried to obtain toner source particles. To remove the organic solvent, for example, the emulsified dispersed reactant is gradually heated while laminar flow is stirred. After brisk stirring in a certain temperature range, it is possible to produce spindle-shaped toner source particles by removing the organic solvent. Further, if acids such as calcium phosphates or alkali soluble materials are used as a dispersion stabilizing agent, such calcium phosphates are dissolved by using acids such as hydrochloric acid, and then the resulting material is cleaned by using water so as to remove the calcium phosphates from the toner source particles. The removal may be conducted through enzyme decomposition.

5) A charge control agent is provided to the obtained toner source particles. Then, inorganic particles such as silica particles and titanium oxide particles are added to obtain toner. In accordance with a well-known method, for example, a method using a mixer, the charge control agent is provided, and the inorganic particles are added.

According to the above-described toner manufacturing method, it is possible to easily obtain toner particles having a small diameter and a sharp diameter distribution. Furthermore, if emulsified dispersed reactant is intensively stirred during a removal process of organic solvent, it is possible to control the shape of toner source particles between true spherical shape and spindle shape. Moreover, it is possible to control surface morphology between smooth surface and rough surface.

Figure 5A:
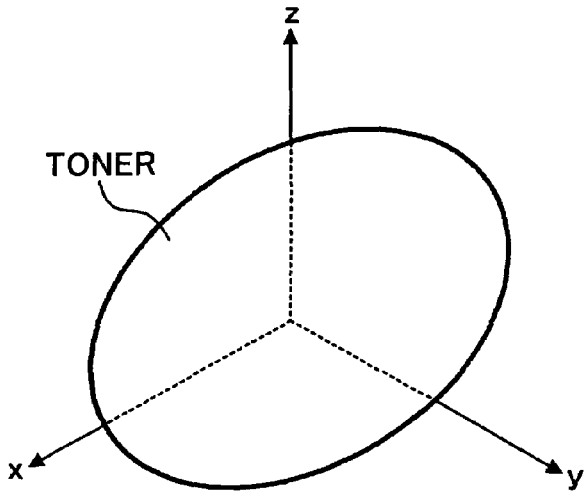
FIGS. 5A through 5C show exemplary shapes of a toner particle according to an embodiment of the present invention.
Figure 5B:
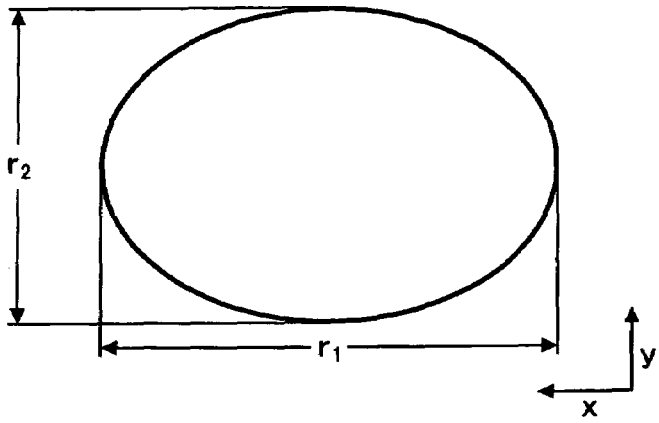
Figure 5C:
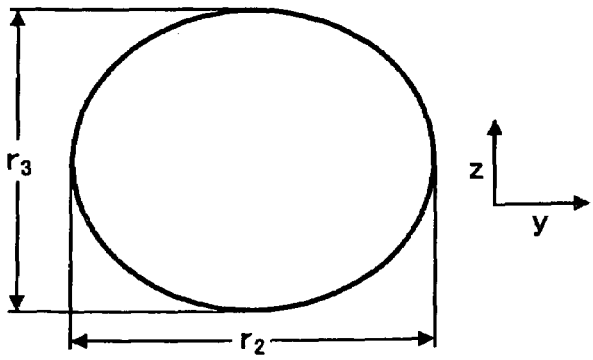

Toner according to an embodiment of the present invention has an almost spherical shape as in the following shape definition. FIGS. 5A through 5C are schematic views showing an exemplary shape of a toner particle according to an embodiment of the present invention.

Referring to FIGS. 5A through 5C, an almost spherical toner particle is defined by the major axial length r1, the minor axial length r2, and the thickness r3 (r1≧r2≧r3). A toner particle according to the present invention preferably has a shape such that the ratio of the minor axial length r2 to the major axial length r1 (r2/r1) is between 0.5 and 1.0, and the ratio of the thickness r3 to the minor axial length r2 (r3/r2) is between 0.7 and 1.0. If the ratio (r2/r1) is less than 0.5, the toner particle is substantially different from true spherical shape. As a result, it is difficult to obtain high-quality images because of insufficient dot reproducibility and transfer efficiency. Further, if the ratio (r2/r1) is less than 0.7, the toner particle has a nearly flat shape. As a result, it is difficult to achieve a high transfer rate unlike a spherical toner particle. In particular, if the ratio (r3/r2) is equal to 1.0, the toner particle has a body of rotation. As a result, it is possible to improve toner flowability.

It is noted that the lengths r1, r2 and r3 are measured by taking pictures of the toner particle from different viewing angles by using a scanning electron microscope (SEM).

Toner manufactured in this manner can be used as single-component magnetic toner without magnetic carrier or non-magnetic toner. Further, if the manufactured toner is used in two-component developer, the toner may be mixed with magnetic carrier. Such magnetic carrier may be a ferrite containing divalent metal such as iron, magnetite, manganese, zinc and copper, and preferably has a volume average particle diameter of 20 through 100 μm. If the average particle diameter is less than 20 μm, it is likely that the carrier may be attached to the photoconductor 1 during development. On the other hand, if the average diameter is larger than 100 μm, toner particles are insufficiently electrified because of an unsatisfactory mixture. In this case, when the developing device is continuously operated, there is a risk that electrification of the toner particles may malfunction. Further, zinc containing Cu ferrite is preferred because of its high saturation magnetization. However, ferrite may be selected depending on a process of the image forming apparatus 100. Further, a magnetic carrier covering resin is not limited to a certain resin. For example, the magnetic carrier covering resin may be silicone resin, styrene-acryl resin, fluorine-contained resin, olefin resin, or the like. The magnetic carrier covering resin may be manufactured by dissolving coating resin in solvent and spraying the resulting solution in a fluidized bed to coat the resin on a core. Alternatively, after the resin particles are electrostatically attached to core particles, the resulting particles may be melted to provide coverage. The thickness of the covered resin is normally between 0.05 and 10 μm, and preferably between 0.3 and 4 μm.

Obviously, numerous modifications and variations of the present invention are possible in light of the above teachings. It is therefore to be understood that within the scope of the appended claims, the present invention may be practiced otherwise than as specifically described herein.

The invention claimed is:

1. An image forming apparatus, comprising:

an image support body; and a lubricant applying part configured to apply lubricant to a surface of the image support body, and including, a roller, and a lubricant containing member configured to seal the lubricant from the roller in the lubricant applying part.

2. The image forming apparatus as claimed in claim 1, wherein the lubricant is a solid lubricant.

3. The image forming apparatus as claimed in claim 1, wherein the lubricant comprises stearic acid zinc.

4. The image forming apparatus as claimed in claim 1, wherein the lubricant containing member is detachable from the lubricant applying part.

5. The image forming apparatus as claimed in claim 1, wherein the lubricant containing member further comprises:

a sheet member (a) configured to seal the lubricant within the lubricant applying part and (b) detachable from the lubricant containing member when the lubricant containing member is installed in the image forming apparatus.

6. The image forming apparatus as claimed in claim 1, wherein the toner particles have a volume average particle diameter (Dv) of from 3 to 8 μm, and a ratio of volume average particle diameter (Dv) to a number average particle diameter (Dn) between 1.00 and 1.40.

7. The image forming apparatus as claimed in claim 1, wherein the toner has a first form factor (SF-1) of from 100 to 180 and a second form factor (SF-2) of from 100 to 180.

8. The image forming apparatus as claimed in claim 1, wherein the toner particles have a shape defined by a major axial length r1, a minor axial length r2, and a thickness r3, where r1≧r2≧r3, and ratios r2/r1 and r3/r2 are between 0.5 and 1.0 and between 0.7 and 1.0, respectively.

9. A process cartridge for an image forming apparatus, comprising:

an image support body;

a lubricant applying part configured to apply the lubricant to a surface of the image support body, and including, a roller, and a lubricant containing member configured to seal the lubricant from the roller in the lubricant applying part; and means for detachably mounting the process cartridge to the image forming apparatus.

10. Toner for use in an image forming apparatus as claimed in claim 1, wherein the toner is prepared by a method comprising:

dispersing or dissolving toner constituents comprising a polyester prepolymer having a functional group having a nitrogen atom, a polyester resin, a colorant, and a release agent in an organic solvent to prepare a toner constituent liquid; and dispersing the toner constituent liquid in an aqueous medium having a compound capable of reacting the functional group of the polyester prepolymer to perform at least one of a crosslinking reaction and an elongation reaction of the polyester prepolymer to form toner particles in the aqueous medium.

11. The toner as claimed in claim 10, wherein the toner particles have a volume average particle diameter (Dv) of from 3 to 8 μm, and a ratio of volume average particle diameter (Dv) to a number average particle diameter (Dn) between 1.00 and 1.40.

12. The toner as claimed in claim 10, wherein the toner has a first form factor (SF-1) of from 100 to 180 and a second form factor (SF-2) of from 100 to 180.

13. The toner as claimed in claim 10, wherein the toner particles have a shape defined by a major axial length r1, a minor axial length r2, and a thickness r3, where r1≧r2≧r3, and ratios r2/r1 and r3/r2 are between 0.5 and 1.0 and between 0.7 and 1.0, respectively.

14. An image forming apparatus, comprising:

an image support body;

lubricant applying means for applying a lubricant to a surface of the image body, and including, means for applying the lubricant, and a lubricant containing means for sealing the lubricant from the means for applying the lubricant in the lubricant applying means.

15. The image forming apparatus as claimed in claim 14, wherein the lubricant is a solid lubricant.

16. The image forming apparatus as claimed in claim 14, wherein the lubricant comprises stearic acid zinc.

17. The image forming apparatus as claimed in claim 14, wherein the lubricant containing means is detachable from the lubricant applying means.

18. The image forming apparatus as claimed in claim 14, wherein the lubricant containing means includes sealing means, detachable from the lubricant applying means, for sealing the lubricant within the lubricant containing means when the lubricant containing means is installed in the image forming apparatus.

19. The image forming apparatus as claimed in claim 1, wherein the lubricant applying part further comprises:

a detachable case configured to hold the lubricant; and a spring mechanism configured to apply pressure against the lubricant to ensure contact between the lubricant and the roller;

wherein the roller is situated adjacent to the lubricant, and is configured to apply the lubricant to the image support body.

20. The image forming apparatus as claimed in claim 1, further comprising:

a cleaning mechanism configured to remove toners remaining on the image support body after transfer of an image, and comprising, a cleaning blade, a support member configured to support the cleaning blade at a predetermined angle adjacent the image support body, a blade pressure applying device configured to apply pressure against the cleaning blade such that the cleaning blade has a predetermined contact pressure against the image support body, and a mechanism configured to collect the removed toners.

* * * * *